United States Patent [19]

Herrmann, Jr.

[11] 4,090,759

[45] May 23, 1978

[54] MICRO-MINIATURE CIRCULAR HIGH VOLTAGE CONNECTOR

[75] Inventor: Henry Otto Herrmann, Jr., Mt. Joy, Pa.

[73] Assignee: AMP Incorporated, Harrisburg, Pa.

[21] Appl. No.: 569,025

[22] Filed: Apr. 17, 1975

[51] Int. Cl.[2] ..... H01R 13/52

[52] U.S. Cl. ..... 339/60 M

[58] Field of Search ..... 339/59–61, 339/89, 94, 186

[56] References Cited

U.S. PATENT DOCUMENTS

| | | | |
|---|---|---|---|
| 2,787,770 | 4/1957 | Arson | 339/63 R |
| 3,445,805 | 5/1969 | McLoad | 339/89 R |
| 3,522,575 | 8/1970 | Watson et al. | 339/94 M |
| 3,745,512 | 7/1973 | Johnson et al. | 339/59 M |
| 3,842,389 | 10/1974 | Glover et al. | 339/60 M |
| 3,842,393 | 10/1974 | Glover et al. | 339/60 M |
| 3,850,495 | 11/1974 | Glover | 339/60 M |
| 3,851,296 | 11/1974 | Muchmore et al. | 339/60 M |

*Primary Examiner*—Joseph H. McGlynn
*Attorney, Agent, or Firm*—Russell J. Egan; Gerald K. Kita

[57] ABSTRACT

A high voltage electrical connector wherein the plug and receptacle include rigid dielectric shells. Electrical sockets are retained within rigid dielectric sleeves molded integral with an interior wall of the receptacle. Insulation covered wires are terminated to the socket and are gathered in a bundling ring and then encapsulated. A soft resilient silicone insert is seated in the forward end of the plug and is provided with tapered recesses for matably receiving the rigid dielectric sleeves of the receptacle. Electrically conducting pins are first terminated to insulation covered wires and are then inserted into the rearward portion of the plug until the pins project into the tapered recesses of the insert. In one version the rearward portion of the plug is then filled with an encapsulant material sealably encircling the insulation covered wires. In another version the silicone insert is provided with elongated tubular extensions which project through apertures in a solid plug end. The tubular sections thus compressibly encircle the corresponding insulation covered wires. The connector is further provided with polarizing features and a threaded coupling to retain the plug and receptacle in mated relationship.

6 Claims, 6 Drawing Figures

76
80
78
86
82
84
56
58
60
46
48
52
50
38
36
40
41
42
12
15
8
18
16
6
2
4
20
1
28
26
32
29
72
70
62
64

MICRO-MINIATURE CIRCULAR HIGH VOLTAGE CONNECTOR

This invention relates to a high voltage multiple wire connector, and more specifically, to a micro-miniature circular high voltage connector capable of interconnecting a plurality of high voltage leads in a minimal space defined within the confines of a connector without short circuiting or arcing between the leads when the connector plug and receptacle portions are mated and when the leads are exposed by the unmated connector portions.

When a high voltage lead of a plurality of high voltage leads are terminated within the confines of a connector plug or receptacle, it is desirable to maintain the leads continuously encircled by dielectric while the plug is unmated to avoid arcing of the lead to adjacent component parts of the connector or to objects externally of the connector. As the number of leads to be contained within a connector increases a problem of electrically isolating the high voltage leads becomes more difficult to solve. Thus incorporation of high voltage leads in a connector must allow for close spacing of the leads while still maintaining electrical isolation between the leads and any external objects with which an unmated connector might inadvertently contact.

In accordance with the present invention, a micro-miniature circular high voltage connector which is compact in size and capable of interconnecting multiple leads energized at very high voltages in the range of 15 kv and 30 kv DC is provided. Both the plug and receptacle portions are molded from a rigid dielectric. The high voltage electrical leads are terminated to conducting sockets which are retained within rigid dielectric sleeves molded integral with the receptacle shell. The sockets are purposely recessed from the ends of the sleeves enabling the dielectric material of the sleeves to cover the conductive sockets and prevent arcing across one another. The dielectric sleeves further prevent touching or close proximity of the sockets to objects externally of the mated receptacle.

The plug is advantageously provided with an insert of silicone rubber which is resilient, rubbery and relatively soft. High voltage electrical leads are terminated to electrically conducting pins retained in recesses within the silicone insert. The silicone thus completely encircles each of the conducting pins to prevent arcing therebetween and to prevent touching or close proximity of the pins with an object externally of the unmated plug. When the plug and receptacle are mated together the silicone insert will sealably and compressibly receive the rigid dielectric sleeves of the receptacle permitting electrical mating engagement of the pins and sockets. In one version the silicone insert may be provided with elongated tubes or sleeves which extend through the plug and sealably encircle Teflon insulation covered wires. In another version, instead of the tubular sleeves, the plug rearward portion is hollow and filled with a potting or encapsulant material which sealably encircles silicone insulation covered wires. Similarly, the rearward portion of the receptacle may have the insulation covered wires encircled by a gathering ring filled by a dielectric, either formed in place as an encapsulant or in the form of a silicone insert through which the wires extend.

It is therefore an object of the present invention to provide a micro-miniature high voltage connector which prevents arcing of high voltage leads terminated to the connector either to the component parts of the connector or to objects external of the connector.

It is a further object of the present invention to provide a connector for high voltage leads wherein electrical sockets are contained within rigid dielectric sleeves and wherein conducting pins are retained within a resilient dielectric sealably receiving the rigid dielectric sleeves when the sockets and pins are electrically mated.

Another object of the present invention is to provide an electrical connector for high voltage leads wherein pins or sockets to which the leads are attached are encircled by dielectric material which prevents arcing of the pins or sockets either to themselves or to objects externally of the connector.

Another object of the present invention is to provide a micro-miniature high voltage connector for high voltage electrical leads with the connector being adaptable to accept either silicone rubber insulated wires or Teflon insulated wires.

The above objects and still further objects and advantages of the present invention will become apparent to those skilled in the art upon perusal of the following detailed description taken in conjunction with the accompanying drawings.

DESCRIPTION OF THE INVENTION

Figures 1, 2:
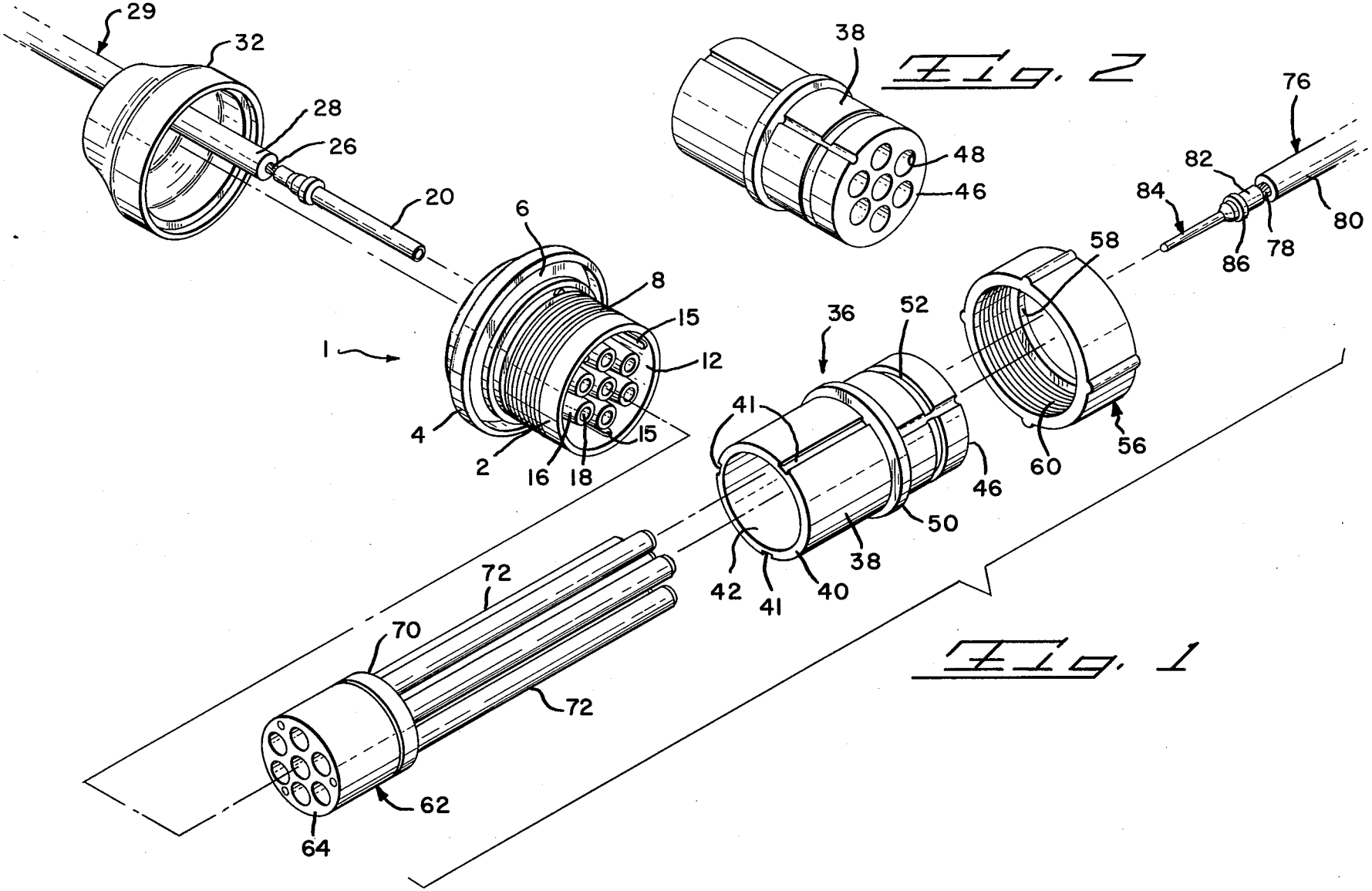
FIG. 1 is an enlarged perspective of a connector according to the present invention with parts in exploded configuration to illustrate the details thereof.
FIG. 2 is an enlarged perspective of a plug shell of a preferred embodiment illustrated in FIG. 1.

With more particular reference to the drawings there is illustrated in FIGS. 1, 2, 5 and 6 a preferred embodiment of a connector according to the present invention including a receptacle 1 comprised of a molded rigid dielectric shell 2 provided with an external annular projecting flange 4 provided with an annular recess 6. The shell is externally threaded at 8. A forward end portion 10 is molded with an inner cylindrical or circular cavity 12 terminating in an integral, radial web or wall 14. A plurality of elongated keys 15 are circumferentially spaced internally of the cavity 12. A plurality of externally tapered sleeves integral with the wall 14 project outwardly therefrom toward the forward end portion 10. The sleeves 16 may project outwardly of the wall 14 to provide tapered end portions 16' of the sleeves which form the rearward end of the receptacle. Each of the sleeves 16 has a cavity 18 extending longitudinally therethrough into which a tubular electrically conducting socket 20 is received and either cemented or molded in place. More particularly each of the conducting sockets 20 includes a radially projecting collar portion seated into a suitably stepped portion of the cavity 18 adjacent the rearward end portion of the receptacle 1. A wire terminating barrel portion 24 of each socket 20 projects outwardly of the rearward end portion of the receptacle and is advantageously terminated by crimping to an electrical conductor 26 protruding from an encircling insulation sheath 28. Together the conductor and insulation sheath form a high voltage lead terminated to a corresponding socket. The forward end portion 30 of each socket is purposely recessed from the end of a corresponding sleeve 16. This insures that the dielectric sleeves purposely encircle and isolate the sockets to prevent their arcing across to one another. The cavities of the sleeves also are of reduced diameter at the forward ends of the sleeves, with the sockets seated in recessed positions. The sleeve ends further prevent contact or close proximity of the sockets with any object externally of the receptacle 1 to prevent arcing or shorting thereto. The high voltage leads of the receptacle are contained within a generally frusto-conical gathering ring 32 which is advantageously attached by a suitable adhesive to the rearward end of the receptacle 1. A suitable dielectric material 34 fills the ring 32 sealably encircling the insulation sheaths 28 and surrounding the high voltage leads and the sockets protruding from the rearward end of the receptacle 1.

Figure 5:
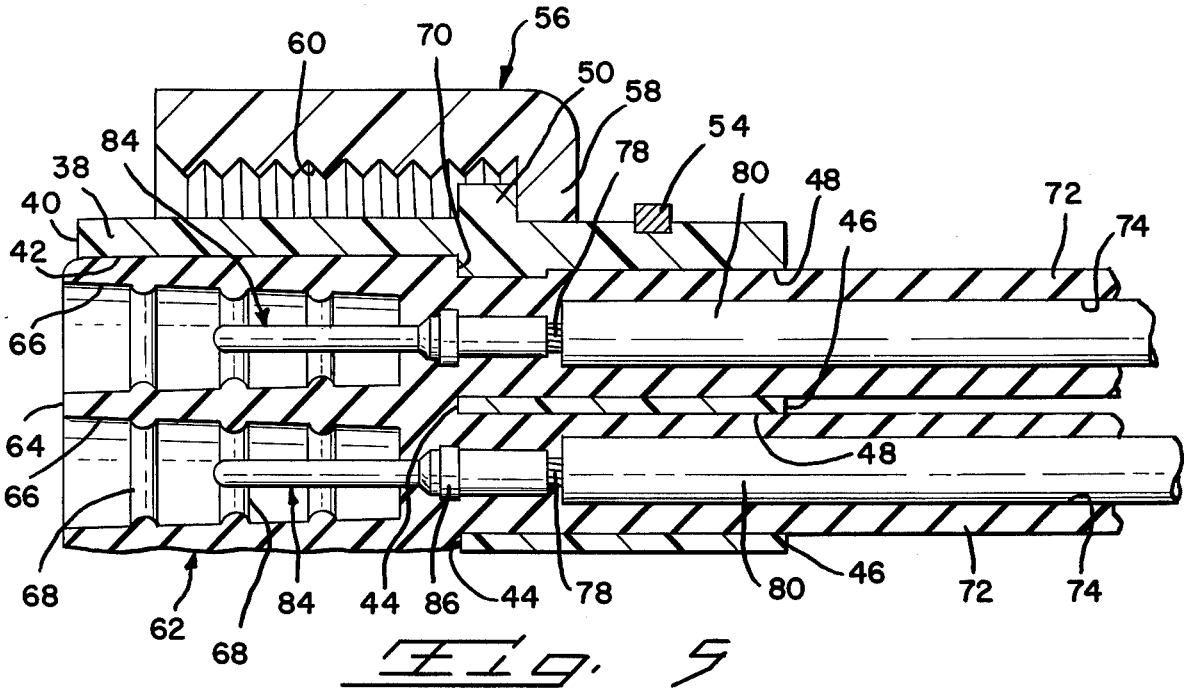
FIG. 5 is an enlarged fragmentary elevation in section of a plug of the connector illustrated in FIG. 1.

As shown more particularly in FIGS. 1, 2 and 5, a plug portion 36 of the connector according to the present invention comprises a molded shell 38 of relatively rigid dielectric material having a forward end portion 40 provided with outer grooved keyways 41 and a cylindrical interior cavity 42. The cavity 42 terminates internally of the shell 38 at a radial internal web or wall 44 which extends continuously to a rearward end portion 46 of the shell 38. As shown more particularly in FIG. 2 the web 44 may be considered to thus provide a solid rearward end 46 for the shell 38. A plurality of apertures 48 are provided through the web or wall 44 communicating with the cavity 42. A medial portion of the shell 38 is provided with an external projecting annular flange 50 and a spaced annular groove 52 receiving a locking ring 54 therein. A ring 56 is freely received over the rearward end 46 of the shell 38 and is provided with an inwardly projecting annular flange 58 which is captured between the locking ring 54 and the flange 50. The ring 56 is internally threaded at 60.

As more particularly shown in FIGS. 1 and 5, the plug 36 is provided with a generally cylindrical insert 62 which is advantageously molded from silicone rubber, a highly resilient, rubbery and soft dielectric material. The forward end portion 64 of the insert 62 is provided with a plurality of molded tapered recesses 66 having a series of integral projecting annular ribs 68 serially spaced along the lengths of the recesses 66. The insert terminates at a rearward end wall 70 from which project integral boots 72. The boots 72 comprise elongated tubular sleeves provided with corresponding longitudinal openings 74 therethrough which communicate with corresponding recesses 66. Shown in FIG. 5 the insert is assembled within the forward end of the shell 38 with the end 70 thereof seated against the web 44 and with the boots entering the apertures of the web. In addition the boots extend outwardly beyond the rearward end 46 of the shell 38. The insert may be cemented in place by a silicone RTV adhesive. High voltage electrical leads 76 include corresponding conductors 78 encircled by insulation sheaths 80. Each conductor 78 is crimped for example to a wire barrel portion 82 of an electrically conducting pin 84. Each pin 84 is provided with an annular projecting collar portion 86. With the leads terminated with corresponding pins, the pins are coated with silicone RTV, serving as a lubricant to facilitate forcible insertion of the terminated leads through corresponding openings 74 in the boots 72. Insertion of the terminated leads is completed when the pins 84 are in proper registration within the rearward end 70 of the insert and project into corresponding recesses 66 of the insert 62. Such proper positioning can be determined by fixtures or jigs against which the pins abut to complete the insertion procedure. The silicone RTV becomes distributed along the boots 72 such that upon curing it serves as an adhesive, cementing the boots in sealed encirclement over the leads and cementing collar portions of the pins within the insert. The silicone rubber material is highly resilient and accordingly resiliently yields to permit insertion of the terminated leads and also to resiliently mold itself to the abrupt surface irregularities; namely the collar portions 86 of the pins, the conductors 75 and the insulation sheaths 80. Thus the silicone intimately encircles the terminated leads with silicone dielectric. The boots further are in compression within the apertures of the web, sealing the rearward end of the plug. Upon mating together the plug 36 and receptacle 1, the forward end portion 40 of the shell 38 will be received internally of the cavity 12 of the shell 2, with the keyways 41 slidably receiving corresponding keys 15 thus polarizing the connector to insure correct mating engagement of the plug and receptacle. The relatively rigid dielectric sleeves 16 will be received within corresponding recesses 66 of the silicone rubber insert 62. The ribs 68 of the insert will be resiliently compressed in sealing encirclement over corresponding sleeves. The conducting sockets 20 within the sleeves will matingly receive therein corresponding pins 84 establishing electrical connection between the leads terminated in the receptacle and in the plug. As shown in FIG. 5 the forward end portion 64 of the insert slightly protrudes from the forward end portion 40 of the plug shell 38. Such protruding portion will be allowed to extrude resiliently in a space defined between the radial wall 14 of the receptacle and the forward end 40 of the plug which insures freedom for resilient expansion of the silicone rubber into compressed conformation with the sleeves when the connector is fully mated. The ring 56 is threadably secured over the threads 8 of the receptacle shell 2 in order to maintain the connector in mated condition.

Figure 3:
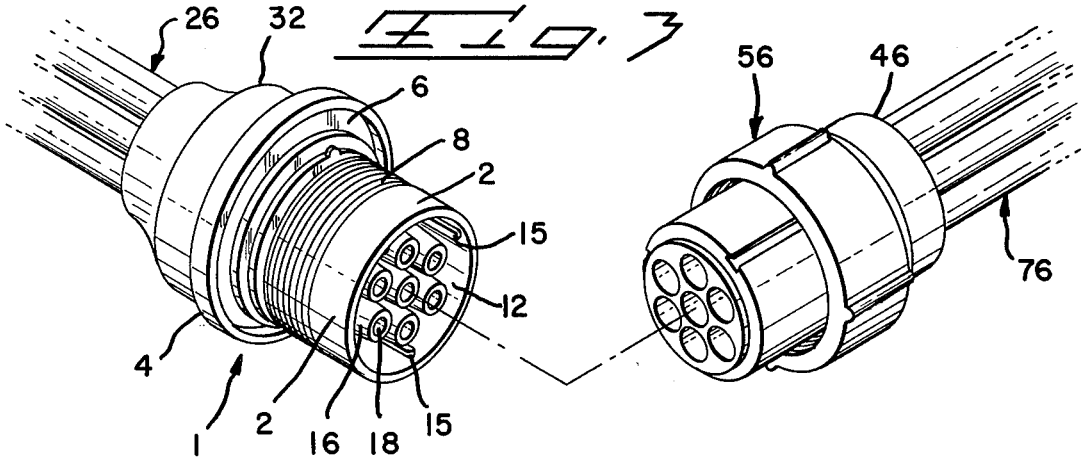
FIG. 3 is an enlarged perspective of another preferred embodiment of a connector according to the present invention with the component parts thereof assembled into an unmated plug and receptacle.
Figure 4:
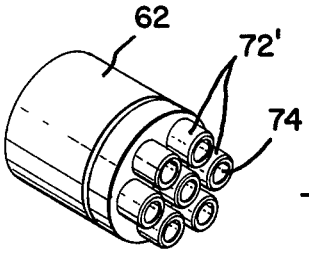
FIG. 4 is an enlarged perspective of a dielectric insert in the plug of the embodiment shown in FIG. 3.
Figure 6:
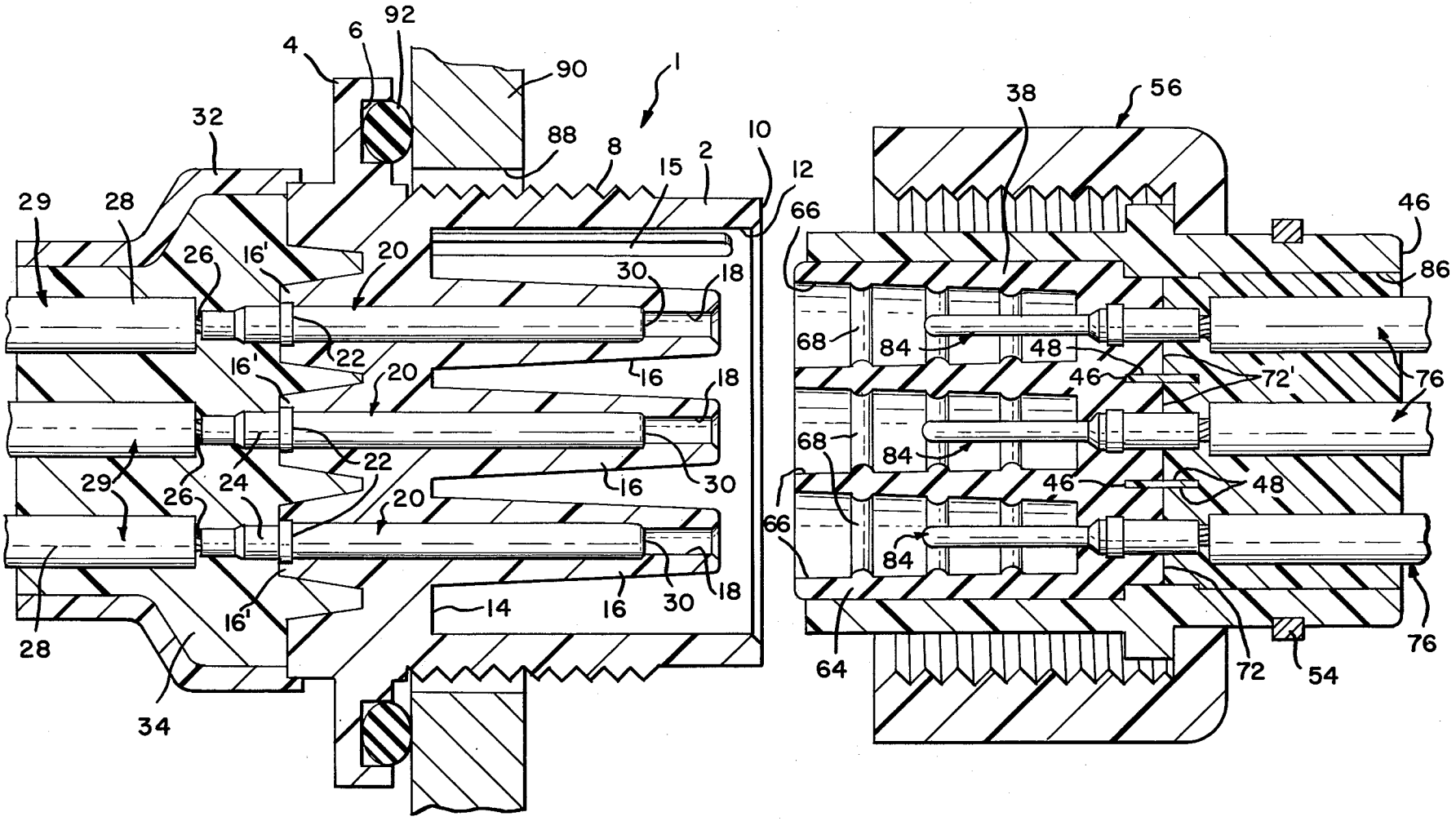
FIG. 6 is an enlarged fragmentary elevation in section of the plug and receptacle illustrated in FIG. 3.

FIGS. 3, 4 and 6 illustrate another version or modification of the plug wherein the rearward end portion 46 is hollow rather than solid as shown in the embodiment of FIG. 2. Thus as shown in FIG. 6 the web portion 46 is not continuous to the end 46 but instead remains entirely internally of the receptacle shell 38. As shown in FIG. 4, the insert 62 is modified in that the elongated boots 72 are replaced by relatively short projecting boots 72'. As shown in FIG. 6, accordingly when the insert 64 is inserted within the shell 38 and is cemented in place by RTV silicone, the boots 72 will enter the apertures 48 of the web 46. The terminated leads 76 are inserted through the boots as in the previous embodiment and are cemented in place within the insert with RTV silicone serving as an adhesive. The hollow rearward end 46 of the shell 38 is then filled with an encapsulant material 86 which intimately and sealably encircles the terminated leads and the insulation sheaths thereof as well as sealably closing the end 46. This modified version of the plug advantageously uses an encapsulant if the insulation sheath of the terminated leads 76 are silicone rubber. The flexibility of silicone rubber prevents easy insertion thereof through elongated tubular sleeves such as the sleeves 72. Thus for ease in fabrication of the plug the encapsulant 86 provides an advantageous technique for closing and sealing the plug end 46 as well as sealably encircling each of the terminated leads 76 with dielectric.

The elongated sleeves or boots 72 are advantageously utilized when the terminated leads 76 are provided with Teflon insulation sheaths 80. Teflon produces less friction than silicone rubber, permitting it to be readily forced down the boots 72. The residue of silicone RTV as well as the resilient encirclement of the silicone boots around the Teflon sheaths 80 provide a suitable seal.

As shown in FIG. 6, the encapsulant 34 within the gathering ring 32 may advantageously comprise a molded silicone rubber insert similar to the insert 62 readily permitting the insulation jackets or sheaths 28 if they are Teflon to be forcibly inserted through the apertures of the insert. Again silicone RTV may be utilized as a lubricant facilitating insertion of the terminated leads 28 and as an adhesive insuring sealing of the silicone rubber encapsulant 34 in resilient encirclement over the sheaths 28. If however the insulation sheaths 28 are silicone rubber, then the dielectric sealant 34 must be an encapsulant such as epoxy which is filled in the ring subsequent to registration of the terminated leads 29 in the receptacle 1. When mounting the connector within an opening 88 of a bulkhead 90, a sealing ring 92 is received in the recess 6 of the flange 4. The bulkhead 90 will be captured between the ring 92 in the flange 4 and the ring 56.

What has been illustrated and described are preferred embodiments of the present invention. Other modifications and embodiments thereof are intended to be covered by the spirit and the scope of the appended claims.

What is claimed is:

1. A high voltage connector, comprising:

a plug, a receptacle, said plug having an outer rigid dielectric shell having a central web provided with apertures therethrough, a compressible dielectric insert within a forward portion of said plug and seated against said web, said insert having integral projecting boot portions entering corresponding apertures in said web, said insert having a plurality of tapered recesses in a forward portion thereof in alignment with said apertures of said web, said boot portions of said insert having openings therethrough communicating with the recesses in said insert, a plurality of first electrical conductors terminated to electrically conducting pins, said pins being received in the openings of said boot portions and said pins projecting into said recesses in said forward portion of said insert, said first electrical conductors being covered with first insulation sheaths entering said shell, means in the rearward portion of said shell encircling said first insulation sheaths, said receptacle having an outer rigid dielectric shell matably receiving said plug shell, said receptacle shell having an inner wall provided with a plurality of dielectric sleeves projecting toward a forward portion of said receptacle shell for mating receipt in said recesses of said insert, said sleeves having cavities extending therethrough, electrically conducting sockets retained in said cavities and matingly receiving said pins, second electrical conductors terminated to said sockets, second insulation sheaths covering said second electrical conductors, means in a rearward portion of said receptacle shell encircling said second insulation sheaths, and said insert protruding from a forward end of said plug shell and is compressed by said receptacle upon mating engagement of said plug shell and said receptacle shell.

2. A high voltage connector, comprising:

a plug, a receptacle, said plug having an outer rigid dielectric shell having a central web provided with apertures therethrough, a compressible dielectric insert within a forward portion of said plug and seated against said web, said insert having integral projecting boot portions entering corresponding apertures in said web, said insert having a plurality of tapered recesses in a forward portion thereof in alignment with said apertures of said web, said boot portions of said insert having openings therethrough communicating with the recesses in said insert, a plurality of first electrical conductors terminated to electrically conducting pins, said pins being received in the openings of said boot portions and said pins projecting into said recesses in said forward portion of said insert, said first electrical conductors being covered with first insulation sheaths entering said shell, means in the rearward portion of said shell encircling said first insulation sheaths, said receptacle having an outer rigid dielectric shell matably receiving said plug shell, said receptacle shell having an inner wall provided with a plurality of dielectric sleeves projecting toward a forward portion of said receptacle shell for mating receipt in said recesses of said insert, said sleeves having cavities extending therethrough, electrically conducting sockets retained in said cavities and matingly receiving said pins, second electrical conductors terminated to said sockets, second insulation sheaths covering said second electrical conductors, means in a rearward portion of said receptacle shell encircling said second insulation sheaths, and said boot portions sealably encircling said electrical leads and projecting outwardly of said plug to sealably encircle substantial lengths of said electrical leads.

3. A readily assembled connector for terminating electrical leads utilizing a compressible dielectric insert which compressibly fills a hollow interior of the connector and compressibly surrounds and supports the terminated leads in the connector, comprising:

an outer shell having an internal web spanning across a hollow interior of said shell and receiving thereagainst an insert of solid and compressible dielectric material which fills the hollow interior of said shell, said insert being provided with integral sleeve-form boots which compressibly fill the apertures of said web and which compressibly encircle electrical leads terminated with electrical contacts, the leads and contacts being cemented in place within the sleeve-form boots and within a rearward end of the insert, and the contacts projecting into recesses in a forward end of the insert, which recesses provided access to the electrical contacts.

4. The structure as recited in claim 3, wherein, the forward end of the insert projects outwardly of a forward end of said outer shell.

5. In the combination of separable and intermateable electrical connector portions each supporting separable and intermateable electrical contacts terminated to corresponding electrical leads, the improvement comprising:

a first connector portion having a hollow interior in which are disposed elongated sleeves of rigid dielectric material supporting corresponding electrical contacts and electrical leads terminated to said electrical contacts, a second connector portion in the form of an outer shell having an internal web spanning across a hollow interior of said shell and receiving thereagainst an insert of solid and compressible dielectric material which fills the hollow interior of said shell, said insert being provided with integral sleeve-form boots which compressibly fill the apertures of said web and which compressibly encircle electrical leads terminated with electrical contacts, the leads and contacts being cemented in place within the boots and within a rearward end of the insert, and the contacts projecting into recesses in a forward end of the insert, which recesses provide access to the electrical contacts.

6. In the combination of separable and intermateable electrical connector portions each supporting separable and intermateable electrical contacts terminated to corresponding electrical leads, the improvement comprising:

a first connector portion having a hollow interior in which are disposed elongated sleeves of rigid dielectric material supporting corresponding electrical contacts and electrical leads terminated to said electrical contacts, a second connector portion in the form of an outer shell having an internal web spanning across a hollow interior of said shell and receiving thereagainst an insert of solid and compressible dielectric material which fills the hollow interior of said shell, said insert being provided with integral sleeve-form boots which compressibly fill the apertures of said web and which compressibly encircle electrical leads terminated with electrical contacts, the leads and contacts being cemented in place within the boots and within a rearward end of the insert, the contacts projecting into recesses in a forward end of the insert, which recesses provide access to the electrical contacts, and the forward end of the insert projects outwardly of a forward end of said outer shell and is receivable in compression against said sleeves of rigid dielectric material upon intermating the electrical connector portions.

* * * * *